US007104849B2

(12) United States Patent
Nimura

(10) Patent No.: US 7,104,849 B2
(45) Date of Patent: Sep. 12, 2006

(54) TERMINAL AND A METHOD OF FORMING IT

(75) Inventor: Kazuhiko Nimura, Yokkaichi (JP)

(73) Assignee: Sumitomo Wiring Systems, Ltd., (JP)

( * ) Notice: Subject to any disclaimer, the term of this patent is extended or adjusted under 35 U.S.C. 154(b) by 0 days.

(21) Appl. No.: 11/136,100

(22) Filed: May 24, 2005

(65) Prior Publication Data

US 2005/0260897 A1 Nov. 24, 2005

(30) Foreign Application Priority Data

May 24, 2004 (JP) ..... 2004-153420

(51) Int. Cl.
*H01R 13/11* (2006.01)

(52) U.S. Cl. ..... 439/856; 439/748; 439/850

(58) Field of Classification Search ..... 439/850, 439/748, 856
See application file for complete search history.

(56) References Cited

U.S. PATENT DOCUMENTS 2,921,287 A * 1/1960 Anderson et al. ..... 439/849
4,781,628 A * 11/1988 Detter et al. ..... 439/748
5,733,154 A * 3/1998 Libregts ..... 439/850
6,325,680 B1 * 12/2001 Suzuki ..... 439/852

FOREIGN PATENT DOCUMENTS

| | | |
|---|---|---|
| EP | 0 602 681 | 6/1994 |
| EP | 0 743 709 | 11/1996 |
| JP | 5-290898 | 11/1993 |

* cited by examiner

*Primary Examiner*—Briggitte Hammond
*Assistant Examiner*—X. Chung-Trans
(74) *Attorney, Agent, or Firm*—Gerald E. Hespos; Anthony J. Casella

(57) ABSTRACT

A terminal (10) has opposite front and rear ends and a receiving plate with lateral edges. Front and rear connecting pieces (17A, 17B) project up from the lateral edges and then curve inwardly. The front connecting piece (17A) is shorter in a front-to-rear direction than the rear connecting piece (17B). The connecting pieces (17A, 17B) extend beyond the widthwise center of the receiving plate (15). Thus, the curved connecting pieces (17A, 17B) overlap when viewed in forward and backward directions. The connecting pieces (17A, 17B) have window holes (19A, 19B) for weakening. The provision of front and rear connecting pieces (17A, 17B) causes inserting force peaks at the front and rear when a mating tab-shaped terminal is inserted. As a result, a peak value is lowered to reduce the inserting force.

12 Claims, 6 Drawing Sheets

TERMINAL AND A METHOD OF FORMING IT

BACKGROUND OF THE INVENTION

1. Field of the Invention

The invention relates to a terminal and to a method of forming it.

2. Description of the Related Art

Japanese Unexamined Patent Publication No. H05-290898A discloses a terminal that has a flat receiving plate with two opposite lateral edges that extend along forward and backward directions. Connecting pieces extend up from the opposite lateral edges of the receiving plate and curve in towards one another to define a substantially heart-shaped space. A mating tab-shaped terminal can be inserted into this space and is squeezed resiliently between the receiving plate and leading ends of the connecting pieces to establish an electrical connection. Terminals of this type are used in automotive wiring harnesses and are available from many companies. For example, The Whitaker Co. sells terminals of this general type under the trademark FastOn.

Terminal fittings of the type shown in Japanese Unexamined Patent Publication No. H05-290898A can be miniaturized by reducing the radii of curvature of the inwardly curved connecting pieces. Thus, the connecting pieces are more rigid and exhibit a higher contact force with the mating tab-shaped terminal. However, this also causes a problem of an increased contact resistance upon inserting the tab-shaped terminal.

The present invention was developed in view of the above problem and an object thereof is to provide a terminal requiring a reduced inserting force.

SUMMARY OF THE INVENTION

The invention relates to a terminal that has a base with lateral edges that extend in forward and backward directions. Connecting pieces curve in from at least one of the edges to define a space between the base and the leading ends of the connecting pieces. A mating terminal can be inserted into the space and can be squeezed resiliently between the base and the leading ends of the connecting pieces to establish electrical connection. The connecting pieces are at different positions along the forward and backward directions.

The mating terminal is inserted into the space adjacent base and causes a first of the connecting pieces to deform resiliently. The mating terminal is pushed further beyond a point of division between the connecting pieces. As a result, the mating terminal then causes a second of the connecting pieces to deform resiliently while the first connecting piece remains deformed.

The above-described prior art terminal requires the entire continuous connecting piece to deform early in the insertion process. Thus, the inserting force increases with a steep gradient and reaches a large peak at a relatively early stage. Contrary to this, the first connecting piece of the terminal fitting of the subject invention is deformed resiliently when the tab-shaped terminal is inserted. Thus, the inserting force increases with a more moderate gradient than in the case of the continuous connecting piece, and then reaches a small peak or plateau. The second connecting piece then is deformed resiliently. Accordingly, the inserting force increases again with a more moderate gradient than in the case of the continuous connecting piece and then reaches a second peak or plateau. This second peak or plateau value is smaller than the peak value of the inserting force with the continuous connecting piece.

In short, the inserting force peaks or plateaus at each of the first and second connecting pieces. Accordingly, the peak value itself can be lowered, and the inserting force can be reduced.

The first connecting piece preferably is at a first edge of the base and the second connecting piece preferably is at a second edge of the base.

The contact length is the same as in the case where the connecting pieces are formed at only one lateral edge of the base. Thus, a contact load can be small. On the other hand, the connecting pieces are parted at the left and right sides and can resiliently contact the left and right areas of the mating tab-shaped terminal. Thus, the tab-shaped terminal can be inserted in a stable posture with a low inserting force.

Leading ends of the front and rear connecting pieces preferably overlap or cross each other when viewed in forward and backward directions.

The connecting pieces are wide and hence can have a large radius of curvature. Thus, rigidity is low and the inserting force is reduced further.

The front connecting piece preferably is formed to be less rigid than the rear connecting piece. Thus, only a small inserting force is necessary at an initial stage by resiliently deforming the less rigid front connecting piece. The inserting force then becomes relatively larger by resiliently deforming the more rigid rear connecting piece. There is a high possibility that the mating terminal will not be aligned properly at the initial stage of the insertion. However, the mating terminal can be aligned easily since the inserting force is small at the initial stage. The inserting force is larger in the latter half of the insertion. However, the mating terminal will already be aligned and can be inserted stably.

The front connecting piece may be longitudinally shorter than the rear connecting piece, and preferably is less than about ⅔ the rear connecting piece. Thus, a less rigid front connecting piece can be achieved easily.

At least one connecting piece can be weakened, preferably by providing one or more windows. Thus, the rigidity of the connecting piece can be reduced to further reduce the inserting force.

The base may have at least one elongated projection and the mating terminal can be squeezed between the projection and the connecting piece.

A lock may project obliquely out from the base and preferably from a location behind the elongated projections.

The connecting piece preferably has one or more guides to achieve a smooth deformation upon insertion of the mating terminal.

The invention also relates to a method of forming a terminal. The method comprises providing a blank with a base that extends forward and back and front and rear connecting pieces at least at one lateral edge of the base. The method then comprises curving the connecting pieces in so that a mating terminal can be inserted between the base and the leading end of the connecting pieces and is resiliently squeezeable therebetween to establish electrical connection. A first connecting piece may be formed at a first edge of the base plate and a second connecting piece may be formed at a second edge substantially opposite the first edge.

These and other objects, features and advantages of the invention will become more apparent upon reading of the following detailed description of preferred embodiments and accompanying drawings. It should be understood that even though embodiments are described separately, single features thereof may be combined to additional embodiments.

DETAILED DESCRIPTION OF THE PREFERRED EMBODIMENTS

Figure 1:
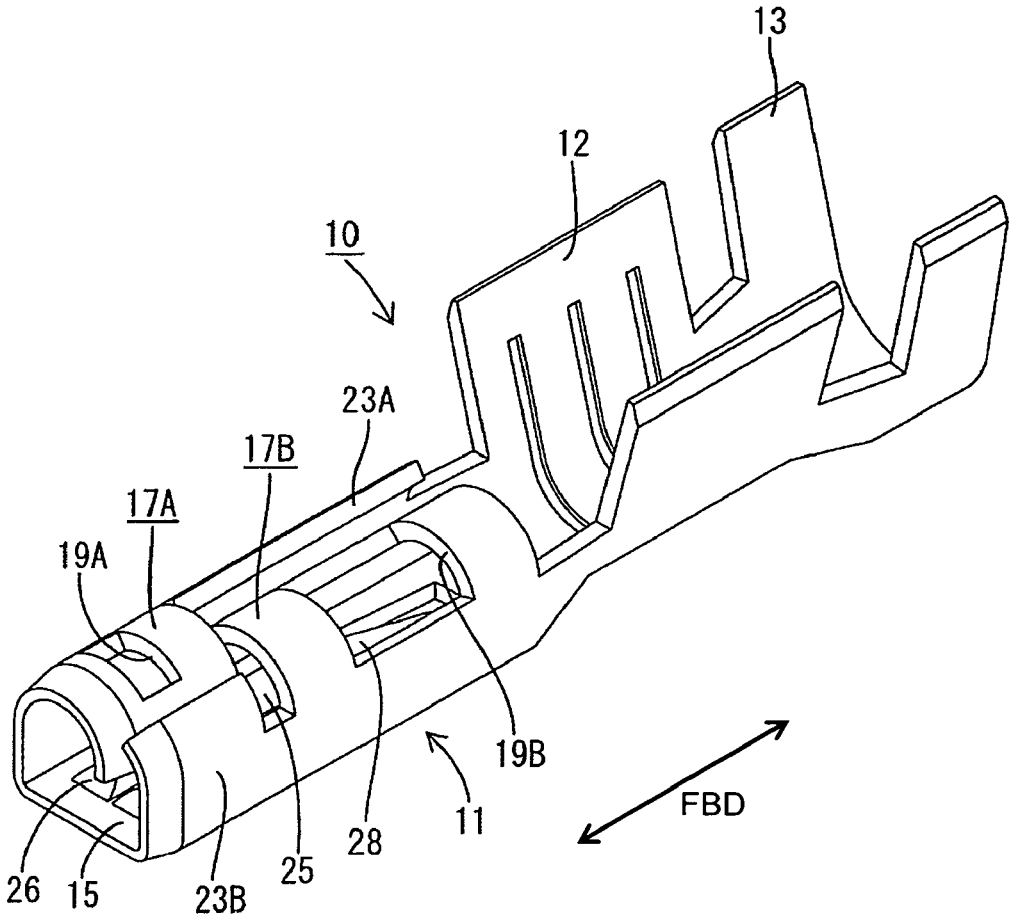
FIG. 1 is a perspective view of a terminal of the faston-type according to one embodiment of the invention.
Figure 2:
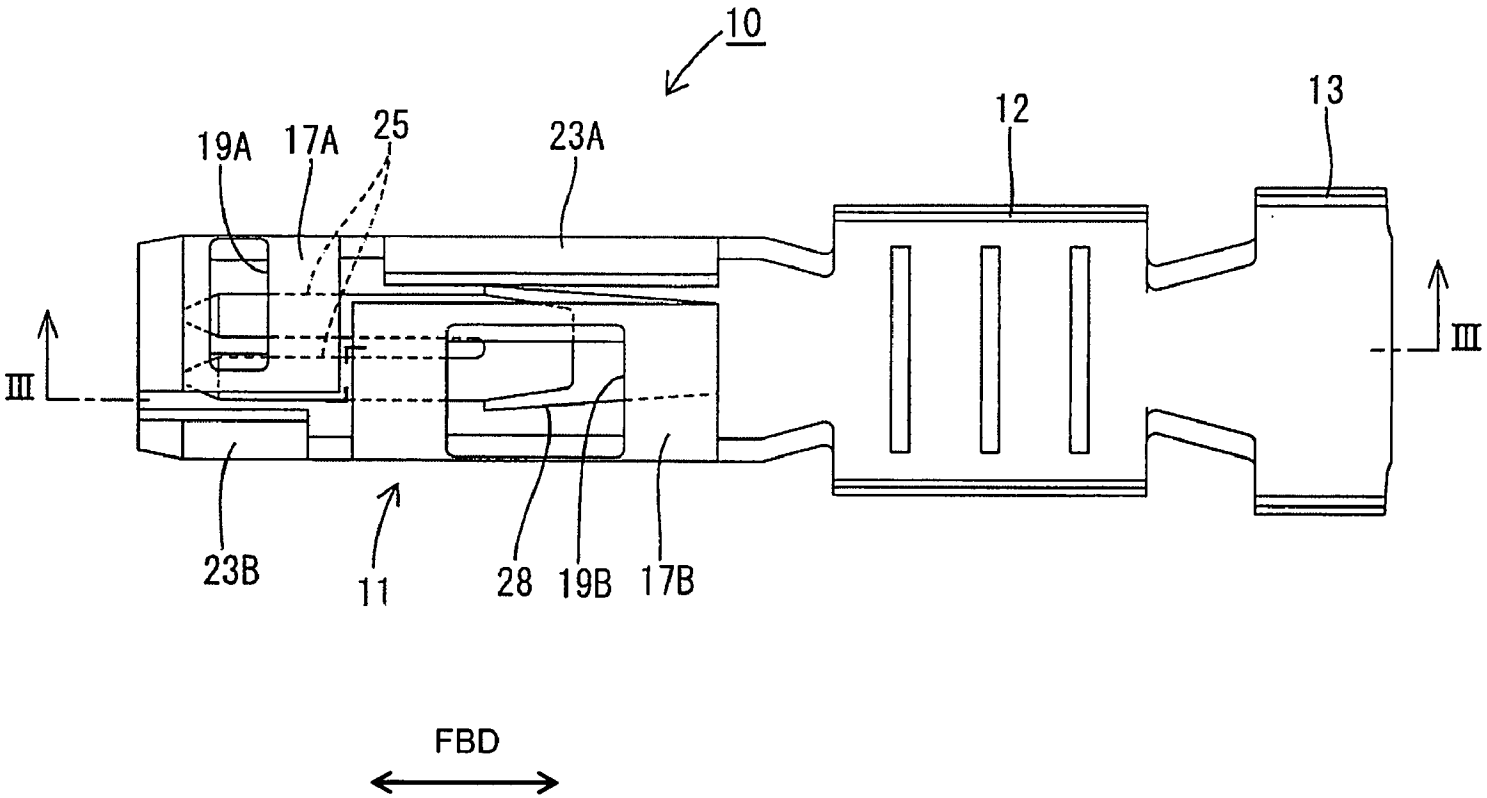
FIG. 2 is a plan view of the terminal.

A terminal according to the invention is identified by the numeral 10 in FIGS. 1 to 5. The terminal 10 is formed by press-working a metal plate having a good electrical conductivity to define a connecting portion 11, a wire barrel 12 behind the connecting portion 11 and an insulation barrel 13 behind the wire barrel 12. The wire barrel 12 is configured for crimped connection with an end of a core W1 of an insulated wire W, while the insulation barrel 13 is configured for crimped connection with an end of an insulation coating W2.

The connecting portion 11 includes a substantially flat receiving plate 15 that is narrow and long along forward and backward directions FBD. The receiving plate 15 has, for example, a length that is more than about one third, preferably about half the entire length of the terminal 10.

A front connecting piece 17A is formed near the front end of the receiving plate 15 and at the left side of the receiving plate 15, when viewed from the front. A rear connecting piece 17B is formed rearward of the front connecting piece and at the right side when view from the front. The front connecting piece 17A is shorter than the rear connecting piece 17B along forward and backward directions FBD. For example, the front connecting piece 17A is about ⅔ the length of the rear connecting piece 17B, and most preferably is slightly longer than half the length of the rear connecting piece 17B. The front and rear connecting pieces 17A and 17B are spaced slightly apart in the forward and backward directions FBD. Thus, the connecting pieces 17A, 17B are arranged alternately at opposite sides of the receiving plate 15, and there is no longitudinal position with both connecting pieces 17A/17B.

Figure 4:
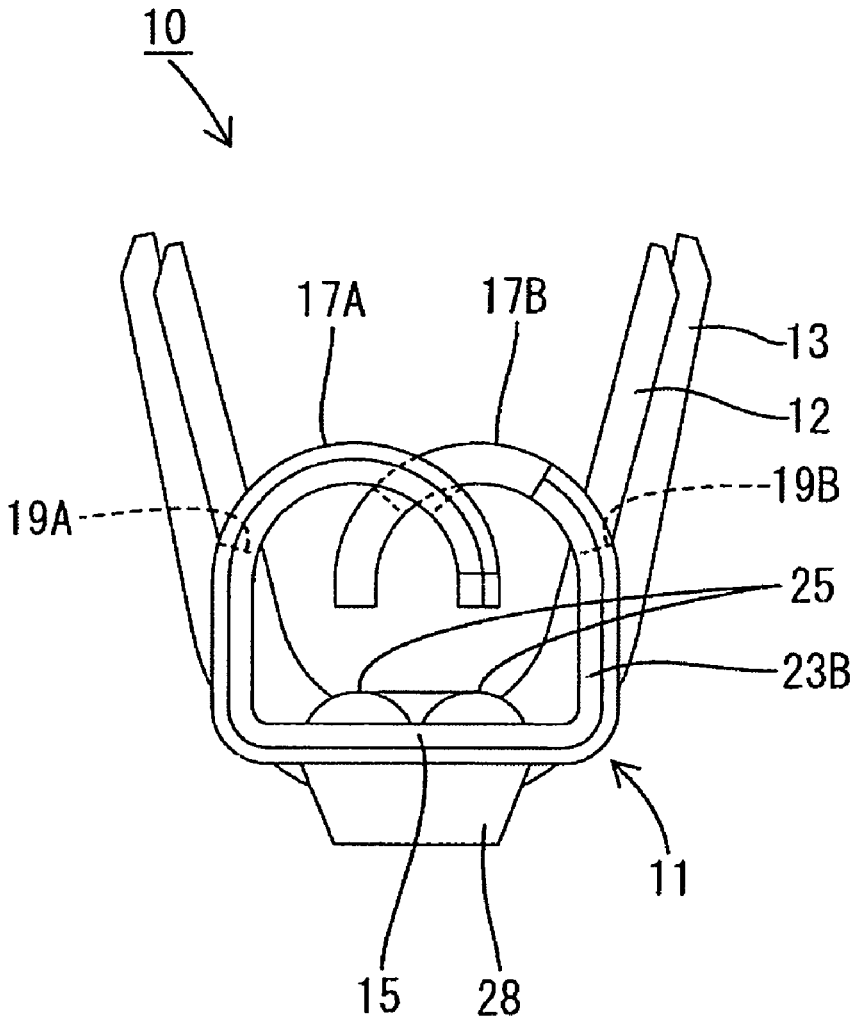
FIG. 4 is a front view of the terminal.

The front and rear connecting pieces 17A, 17B project up a from the corresponding sides of the receiving plate 15 and then curve in towards a tab-receiving space to define a substantially heart-shaped cross section. Leading ends of the connecting pieces 17A, 17B are spaced up from the receiving plate 15, as shown in FIG. 4. Thus, the leading ends are curved with a radius of curvature to overlap when viewed in the forward and backward directions FBD. Windows 19A, 19B are formed in longitudinal intermediate parts of the connecting piece 17A and/or 17B for weakening.

Two elongated projections 25 are formed in a widthwise-intermediate part of the receiving plate 15 and extend in substantially the forward and backward directions FBD. The projections 25 have front ends retracted slightly from the front edge of the receiving plate 15. The projections 25 then continue rearward to positions more than about one-fourth, and preferably substantially one-third the length of the rear connecting piece 17B from the front. The illustrated projections 25 are embossed, but they may also be cut and bent. As described later, the tab-shaped terminal 40 is inserted from the front and along an inserting direction ID into positions between the projections 25 and the leading ends of the connecting pieces 17A, 17B. Thus, a space measured substantially normal to the inserting direction ID between the projections 25 and the leading ends of the unbiased connecting pieces 17A, 17B is less than the thickness T of the tab-shaped terminal 40.

Figure 3:
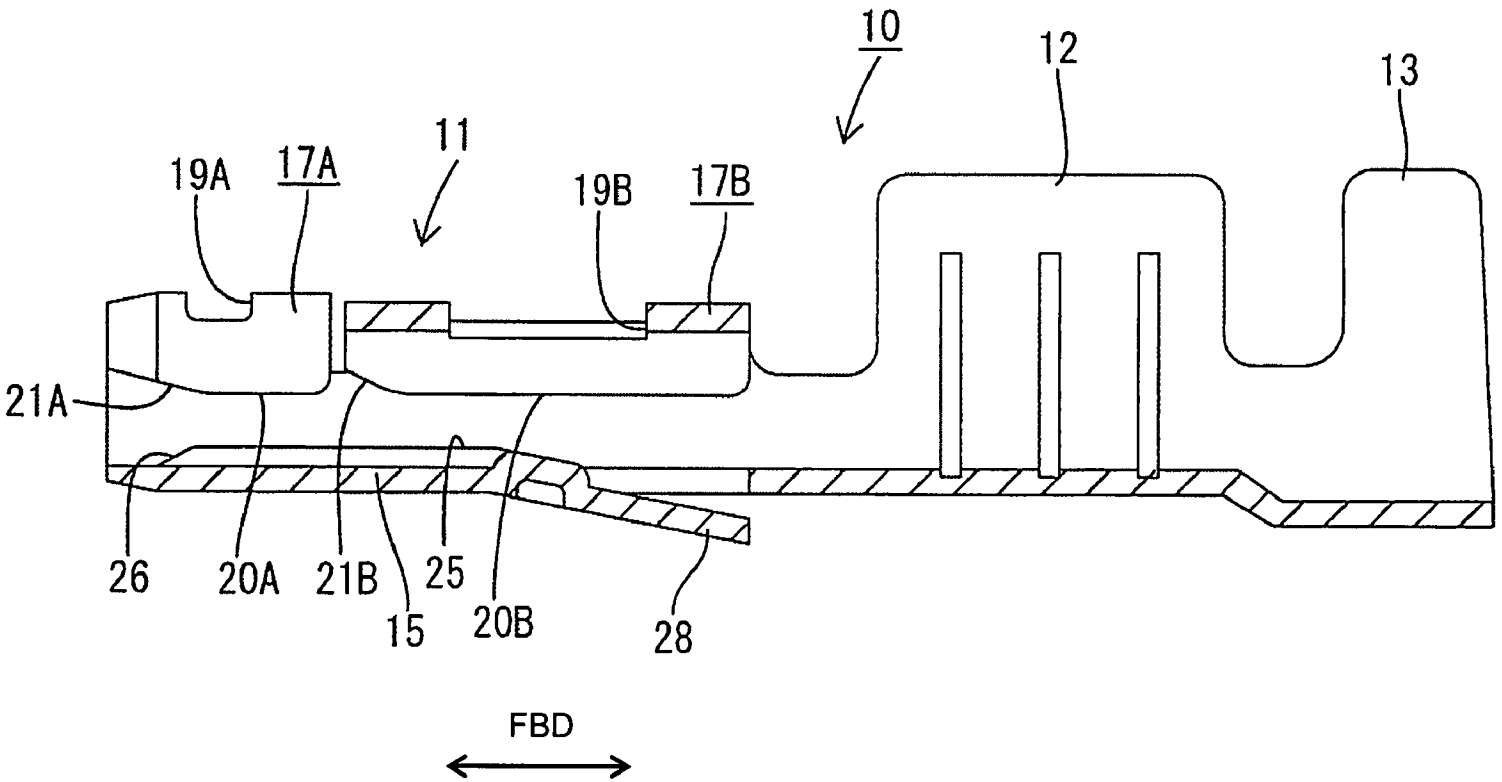
FIG. 3 is a section along III—III of FIG. 2.

As shown in FIG. 3, rounded guides 26 are formed at the front of each elongated projection 25 and slant up towards the back. A slanted guiding edge 21A slopes down and towards the back from a front of the front connecting piece 17A and continues to a leading end edge 20A of the front connecting piece 17A. The guiding edge 21A has a length of slightly less than about half the leading edge 20A. A slanted guiding edge 21B slopes down towards the back at the front of a leading end edge 20B of the rear connecting piece 17B.

Side plates 23A, 23B project substantially normal to the receiving plate 15 at a rear side of the left edge of the receiving plate 15 where the front connecting piece 17A is not formed and at a front side of the right edge where the rear connecting piece 17B is not formed. A metal lock 28 is embossed at a position on the receiving plate 15 behind the elongated projections 25 and has a leading end that faces obliquely down towards the back.

The connecting portion 11 is formed so that the front connecting piece 17A at the left edge of the receiving plate 15 and the rear connecting piece 17B at the right edge are separated along the forward and backward directions FBD. Additionally, the front connecting piece 17A is shorter than the rear connecting piece 17B, and therefore less rigid. The connecting pieces 17A, 17B also can achieve different rigidity by changing the material properties, the material thicknesses, the geometrical shapes (e.g. bending radii) and/or the sizes of the windows 19A, 19B of the connecting pieces 17A, 17B.

Figure 5:
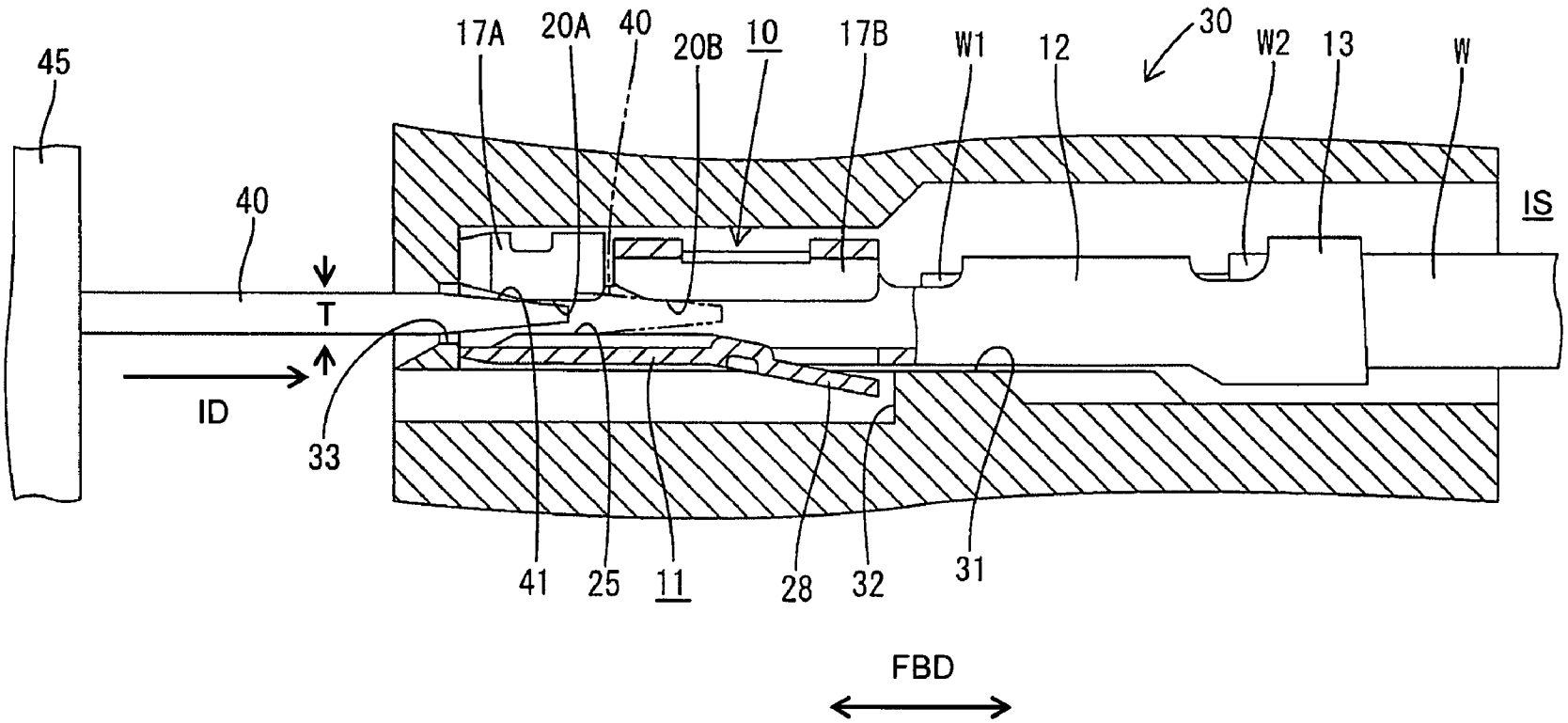
FIG. 5 is a section showing insertion of a mating tab terminal.

As shown in FIG. 5, the terminal 10 is accommodated in a housing 30 made e.g. of a synthetic resin. Cavities 31 are formed in the housing 30 and extend in forward and backward directions FBD. A locking step 32 is formed at the bottom wall of each cavity 31 and engages the metal lock 28 when the terminal 10 is inserted to a proper position from an inserting side IS. Further, a terminal insertion opening 33 is formed in the front wall of the cavity 31 for receiving the mating terminal 40 in the inserting direction ID.

The terminal 40 has a tab that projects from a connecting surface of a housing 45 that is formed unitarily formed with a casing of a device. A tapered guide 41 is formed at the leading end of the tab-shaped terminal 40.

The barrels 12, 13 are crimped, bent or folded into connection with the end of the insulated wire W. The terminal 10 then is inserted in a corresponding cavity 31 of the housing 30 from behind, and is pushed to deform the metal lock 28. The leading end of the metal lock 28 passes the locking step 32 when the terminal 10 is inserted a specified amount. Thus, the metal lock 28 is restored resiliently to engage the locking step 32 and to retain the terminal 10 in the cavity 31. A space between the leading end of the front connecting piece 17A and the elongated projections 25 at the front of the terminal 10 is right behind the terminal insertion opening 33.

The housing 30 is connected with the mating housing 45 after the terminals 10 have been inserted in the cavities 31. The tab-shaped terminals 40 pass through the terminal insertion openings 33 at an initial stage of the connection and then move between the leading ends of the front connecting pieces 17A and the elongated projections 25 of the terminals 10, as shown in solid line in FIG. 5. The terminals 40 are pushed further and resiliently deform the front connecting pieces 17A up and out. The tab-shaped terminals 40 move between the leading ends of the rear connecting pieces 17B and the elongated projections 25 as the connection progresses. Thus the rear connecting pieces 17B deform resiliently up and out, while the front connecting pieces 17A remain deformed. The tab-shaped terminals 40 are squeezed resiliently between the front and rear connecting pieces 17A, 17B and the elongated projections 25 to establish electrical connections with the corresponding terminals 10 as the housing 30 is pushed to a properly connected state.

Figure 6:
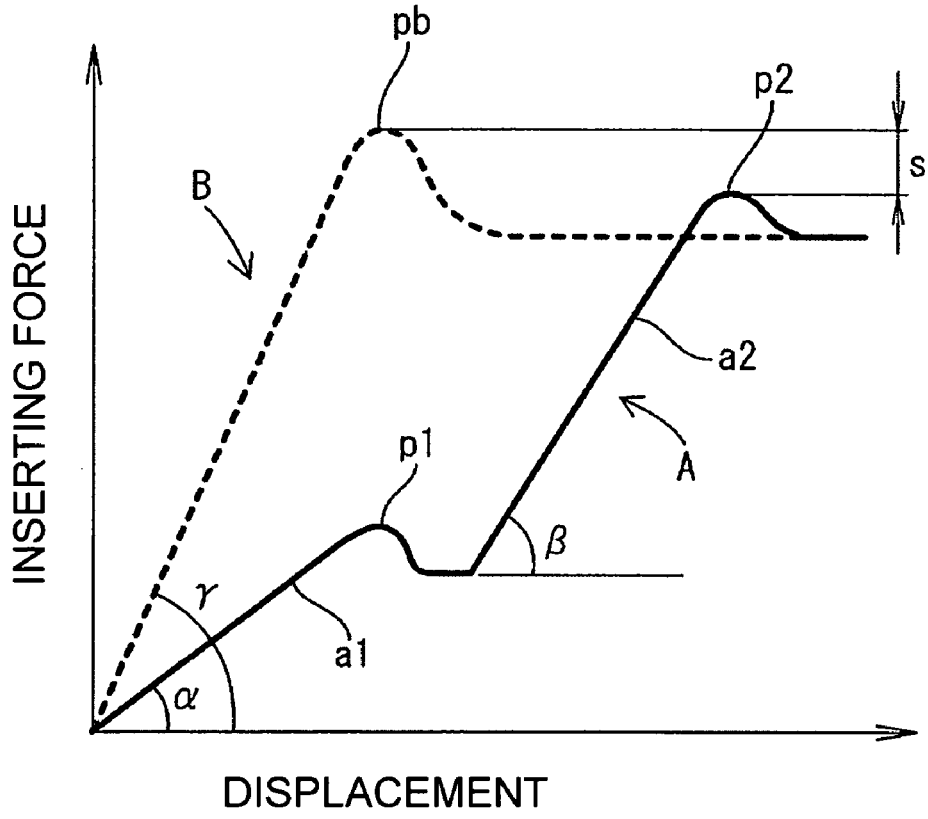
FIG. 6 is a graph showing the characteristics of an inserting force.

FIG. 6 illustrates a characteristic curve A of an inserting force of the tab-shaped terminal 40 into the terminal 10 relative to the depth of insertion. More specifically, the guide 41 at the leading end of the tab shaped terminal 41 pushes the leading edge 20A of the front connecting piece 17A when the tab-shaped terminal 40 is inserted between the front connecting piece 17A and the elongated projections 25. Thus, the tab-shaped terminal 40 gradually deforms the front connecting piece 17A up and out as shown by a characteristic curve section a1 and, accordingly, the inserting force increases. The origin of the graph represents the initial contact of the tab-shaped terminal 40 with the leading edge 20A of the front connecting piece 17A. The front connecting piece 17A is relatively short and has a relatively low rigidity. Thus, the inserting force increases with a moderate gradient (angle $\alpha$). Thereafter, the front connecting piece 17A is substantially maximally resiliently deformed when a portion of the tab-shaped terminal 40 behind the guide 41 contacts the leading edge 20A of the front connecting piece 17A, (assuming that the thickness T of the tab-shaped terminal 40 behind the guiding surface 41 is substantially constant) and the inserting force reaches a small peak (peak value p1).

The tab-shaped terminal 40 then moves between the rear connecting piece 17B and the elongated projection 25. As a result, the guide 41 at the leading end of the tab-shaped terminal 40 pushes the leading edge 20B of the rear connecting piece 17B to deform the rear connecting piece 17B gradually up and out and. Accordingly, the inserting force increases. The rear connecting piece 17B is relatively long and has a higher rigidity. Therefore, the inserting force increases with a relatively steep gradient (angle $\beta$). The gradient (angle $\beta$) of the inserting force needed to insert the terminal 40 between the rear connecting piece 17B an the elongated projections 25 is greater that the gradient (angle $\alpha$) of the inserting force needed to insert the terminal 40 between the front connecting piece 17A an the elongated projections 25, i.e. $\beta>\alpha$, preferably $\beta$ is more than about 1.3 times, more preferably more than about 1.5 times $\alpha$. The rear connecting piece 17B is deformed maximally and the inserting force reaches a second peak (peak value p2) when the portion of the tab-shaped terminal 40 behind the guide 41 contacts the leading end edge 20B of the rear connecting piece 17B.

The terminal 10 has the front and rear connecting pieces 17A, 17B supported respectively at the opposite lateral sides. Thus, a total contact length is same as in the case where a continuous connecting piece is provided only at one lateral edge of the receiving plate 15. For a comparison, an inserting force is studied for a continuous connecting piece at one lateral edge of the receiving plate. This inserting force is represented by a characteristic curve B of FIG. 6. Specifically, the guide 41 at the leading end of the tab-shaped terminal 40 pushes the leading edge of the continuous connecting piece to deform the connecting piece gradually up and out as the tab-shaped terminal 40 is inserted. The connecting piece is deformed maximally when the portion of the tab-shaped terminal 40 behind the guide 41 contacts the leading end edge of the connecting piece and the inserting force reaches a peak value pb. The connecting piece is continuous and has a high rigidity. Thus, the inserting force increases with a steep gradient (angle $\gamma$) and the peak value bp of the inserting force is larger than the second peak value p2 of this embodiment by "s". In other words, the peak value of the inserting force itself is lowered by dividing the connecting piece into the front and rear connecting pieces 17A, 17B.

As described above, the total contact length of the two connecting pieces 17A, 17B in the terminal 10 is the same as in the case where the connecting piece is formed only at one lateral edge of the receiving plate 15. However, a contact load can be low. In addition, the front and rear connecting pieces 17A, 17B generate inserting force peaks at the front and rear sides. Accordingly, the peak value can be lowered. As a result, the overall inserting force is reduced remarkably. Further, since the front and rear connecting pieces 17A, 17B are at the lateral sides, the mating tab-shaped terminal 40 is resiliently in contact over the left and right areas. Therefore, the tab-shaped terminal 40 can be inserted in a stable posture.

The front and rear connecting pieces 17A, 17B are formed so that their leading sides overlap when viewed in forward and backward directions FBD. Therefore, the front and rear connecting pieces 17A, 17B are wide and can have large radii of curvature. Thus, rigidity can be lowered to further reduce the inserting force. Further, the windows 19A, 19B weaken the connecting pieces 17A, 17B to reduce the inserting force further. The windows 19A, 19B extend over more than about half of the extension of the bent portion of the connecting piece 17A, 17B where the connecting piece 17A, 17B is bent inwardly. Thus, the windows 19A, 19B preferably extend towards the leading end edges 20A, 20B of the connecting pieces 17A, 17B over a distance of more than about half the extension of the connecting pieces 17A, 17B. Moreover, the window holes 17A, 17B may be provided partly in the portion of the connecting pieces 17A, 17B that project up from the corresponding edges of the receiving plate 15 in an angled way without being bent.

The front connecting piece 17A preferably is less rigid than the rear connecting piece 17B. Thus, the inserting force can be smaller by resiliently deforming the less rigid front connecting piece 17A at the initial stage of inserting the mating terminal 40. The inserting force becomes larger by successively resiliently deforming the more rigid rear connecting piece 17B. There is a high possibility that the tab-shaped terminal 40 is not aligned at the initial stage of the insertion of the tab-shaped terminal 40. However, the tab-shaped terminal 40 can be aligned easily since the inserting force is small at the initial stage. Although the inserting force is relatively larger in the latter half, the tab-shaped terminal 40 is aligned and can be inserted stably.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The lengths, radii of curvature and/or shapes of the front and rear connecting pieces may be varied to change the rigidities of the front and rear connecting pieces. Thus, targeted rigidities can be achieved easily.

The front and rear connecting pieces need not overlap when viewed from the front. The entire contact length of this terminal remains long, but the peak value of the inserting force is decreased by providing the front and rear pieces. As a result, the inserting force can be reduced.

The receiving plate 15 has been described as substantially flat and the mating terminal 40 as substantially tab-shaped. However, the invention is also applicable to terminals having a rounded, elliptic, circular or the like cross-section and mating terminals having shapes substantially different from a tab.

What is claimed is:

1. A terminal, comprising:

a base plate having opposite front and rear ends and opposite first and second lateral edges extending in substantially forward and backward directions; and a front connecting pieces extending from the first lateral edge of the base plate substantially adjacent the front end of the base plate and curved inwardly towards the second lateral edge, the second lateral edge being free of a connecting piece opposed to the front connecting piece, a rear connecting piece extending from the second lateral edge of the base plate rearward of the front connecting piece and being curved inwardly towards the first lateral edge of the base plate, the first lateral edge of the base plate being free of a connecting piece opposed to the rear connecting piece, whereby a mating terminal can be inserted between leading ends of the connecting pieces and the base plate and squeezed resiliently therebetween for establishing an electrical connection.

2. The terminal of claim 1, wherein leading end sides of the front and rear connecting pieces overlap each other when viewed in forward and backward directions.

3. The terminal of claim 1, wherein the front connecting piece is less rigid than the rear connecting piece.

4. The terminal of claim 3, wherein the front connecting piece is shorter than about ⅔ the rear connecting piece along the forward and backward directions.

5. The terminal of claim 1, wherein the front and rear connecting pieces are spaced apart along the forward and backward directions.

6. The terminal of claim 1, wherein the connecting pieces are weakened by at least one window.

7. The terminal of claim 1, wherein the base plate comprises at least one elongated projection provided substantially along the forward and backward directions for squeezing the mating terminal between the elongated projections and the connecting pieces.

8. The terminal of claim 1, wherein the base plate comprises at least one lock with a leading end that faces obliquely out toward the back from a position behind the elongated projections.

9. The terminal of claim 1, wherein the base plate has a selected width dimension extending between the first and second opposite lateral edges, the leading end of the front connecting piece being spaced from the first lateral edge of the base plate by a distance greater than one-half of the width dimension of the base plate and the leading end of the rear connecting piece being spaced from the second lateral edge of the base plate by a distance greater than one-half the width of the base plate.

10. The terminal of claim 9, wherein the leading end of the front connecting piece is spaced from the first lateral edge of the base plate by a distance substantially equal to a distance between the leading end of the rear connecting piece and the second lateral edge of the base plate.

11. The terminal of claim 1, wherein the base plate is formed with first and second elongated projections extending substantially along the forward and backward directions, the first elongated projection being closer to the first lateral edge of the base plate than the second lateral edge of the base plate, the second elongated projection being closer to the second lateral edge of the base plate than to the first lateral edge thereof, the leading end of the front connecting piece being substantially opposed to the second elongated projection and the leading end of the rear connecting piece being substantially opposed to the first elongated projection.

12. The terminal of claim 11, wherein the first and second elongated projections are formed substantially symmetrically on the base plate with respect to a center line between the first and second opposite lateral edges.

* * * * *